US005852840A

United States Patent [19]

Lapp

[11] Patent Number: 5,852,840

[45] Date of Patent: Dec. 29, 1998

[54] KNIFE AND TACKING DEVICE

[76] Inventor: Levi S. Lapp, 245 Hill Rd., New Holland, Pa. 17557

[21] Appl. No.: 808,425

[22] Filed: Feb. 28, 1997

[51] Int. Cl.[6] ..... B26B 11/00

[52] U.S. Cl. ..... 7/158; 227/133

[58] Field of Search ..... 7/144, 158; 227/133

[56] References Cited

U.S. PATENT DOCUMENTS

| | | | |
|---|---|---|---|
| 1,572,898 | 2/1926 | Martin | 7/144 |
| 2,635,337 | 4/1953 | Mercy | 7/158 X |
| 2,664,565 | 1/1954 | Percoco | 227/133 X |
| 3,233,643 | 2/1966 | Reuterfors | 7/158 |
| 5,477,601 | 12/1995 | Jasmer | 7/158 X |

*Primary Examiner*—James G. Smith

[57] ABSTRACT

A device for cutting sealing paper and tacking such paper during a roofing procedure. The inventive device includes a tacking assembly for dispensing tacks or staples in response to an impacting thereof against a surface. A cutting blade extends from the tacking assembly for cutting sealing paper to eliminate the need for multiple tools.

1 Claim, 3 Drawing Sheets

20
12
10
16
14
24
18
26

16

14
22
18
10
24

KNIFE AND TACKING DEVICE

BACKGROUND OF THE INVENTION

1. Field of the Invention

The present invention relates to a knife and tacking device and more particularly pertains to cutting sealing paper and tacking such paper during a roofing procedure.

2. Description of the Prior Art

The use of impact driven fastening tools is known in the prior art. More specifically, impact driven fastening tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art impact driven fastening tools include U.S. Pat. No. 3,927,432; U.S. Pat. No. 3,758,016; and U.S. Pat. No. 4,367,833.

While these devices fulfill their respective, particular objectives and requirements, the aforementioned patents do not disclose a knife and tacking device for cutting sealing paper and tacking such paper during a roofing Procedure which includes a tacking assembly for dispensing tacks or staples in response to an impacting thereof against a surface, and a cutting blade extending from the tacking assembly for cutting sealing paper to eliminate the need for multiple tools.

In these respects, the knife and tacking device according to the present invention substantially departs from the conventional concepts and designs of the prior art, and in so doing provides an apparatus primarily developed for the purpose of cutting sealing paper and tacking such paper during a roofing procedure.

SUMMARY OF THE INVENTION

In view of the foregoing disadvantages inherent in the known types of impact driven fastening tools now present in the prior art, the present invention provides a new knife and tacking device construction wherein the same can be utilized for cutting sealing paper and tacking such paper during a roofing procedure. As such, the general purpose of the present invention, which will be described subsequently in greater detail, is to provide a new knife and tacking device apparatus and method which has many of the advantages of the impact driven fastening tools mentioned heretofore and many novel features that result in a knife and tacking device which is not anticipated, rendered obvious, suggest ed, or even implied by any of the prior art impact driven fastening tools, either alone or in any combination thereof.

To attain this, the present invention generally comprises a device for cutting sealing paper and tacking such paper during a roofing procedure. The inventive device includes a tacking assembly for dispensing tacks or stapes in response to an impacting thereof against a surface. A cutting blade extends from the tacking assembly for cutting sealing paper to eliminate the need for multiple tools.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved knife and tacking device which has all the advantages of the prior art impact driven fastening tools and none of the disadvantages.

It is another object of the present invention to provide a new and improved knife and tacking device which may be easily and efficiently manufactured and marketed.

It is a further object of the present invention to provide a new and improved knife and tacking device which is of a durable and reliable construction.

An even further object of the present invention is to provide a new and improved knife and tacking device which is susceptible of a low cost of manufacture with regard to both materials and labor, and which accordingly is then susceptible of low prices of sale to the consuming public, thereby making such knife and tacking device economically available to the buying public.

Still yet another object of the present invention is to provide a new and improved knife and tacking device which provides in the apparatuses and methods of the prior art some of the advantages thereof, while simultaneously overcoming some of the disadvantages normally associated therewith.

Still another object of the present invention is to cut sealing paper and tack such paper during a roofing procedure.

Lastly, it is an object of the present invention to provide a new and improved device for cutting sealing paper and tacking such paper during a roofing procedure. The inventive device includes a tacking assembly for dispensing tacks or staples in response to an impacting thereof against a surface. A cutting blade extends from the tacking assembly for cutting sealing paper to eliminate the need for multiple tools.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
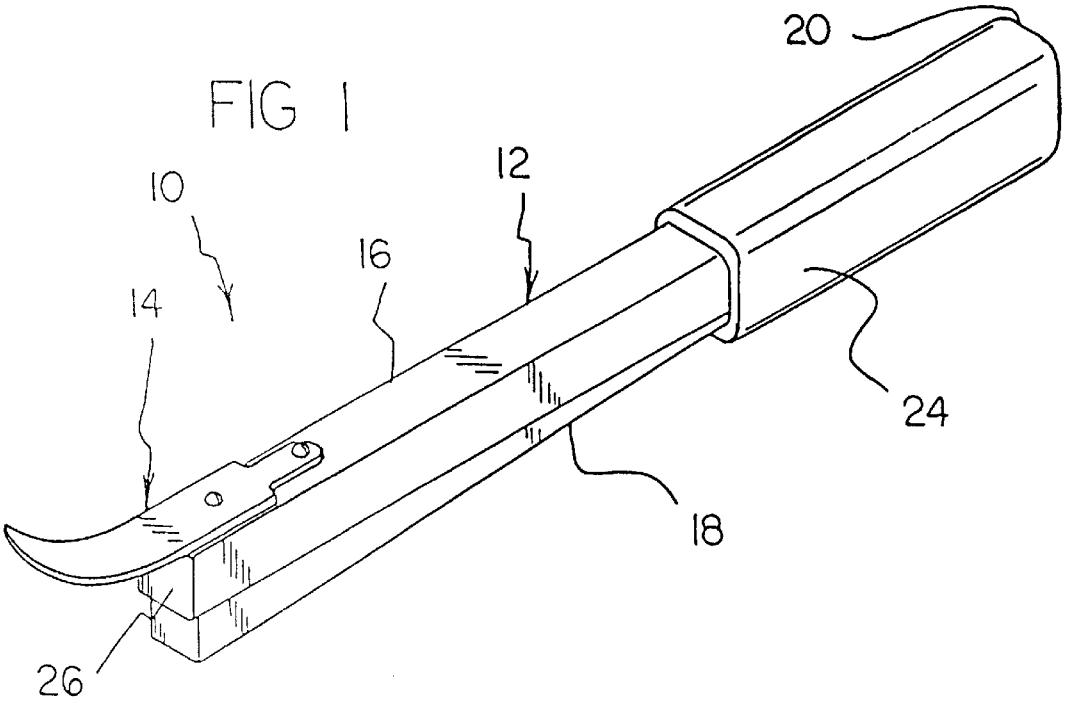
FIG. 1 is a isometric illustration of a knife and tacking device according to the present invention.
Figure 6:
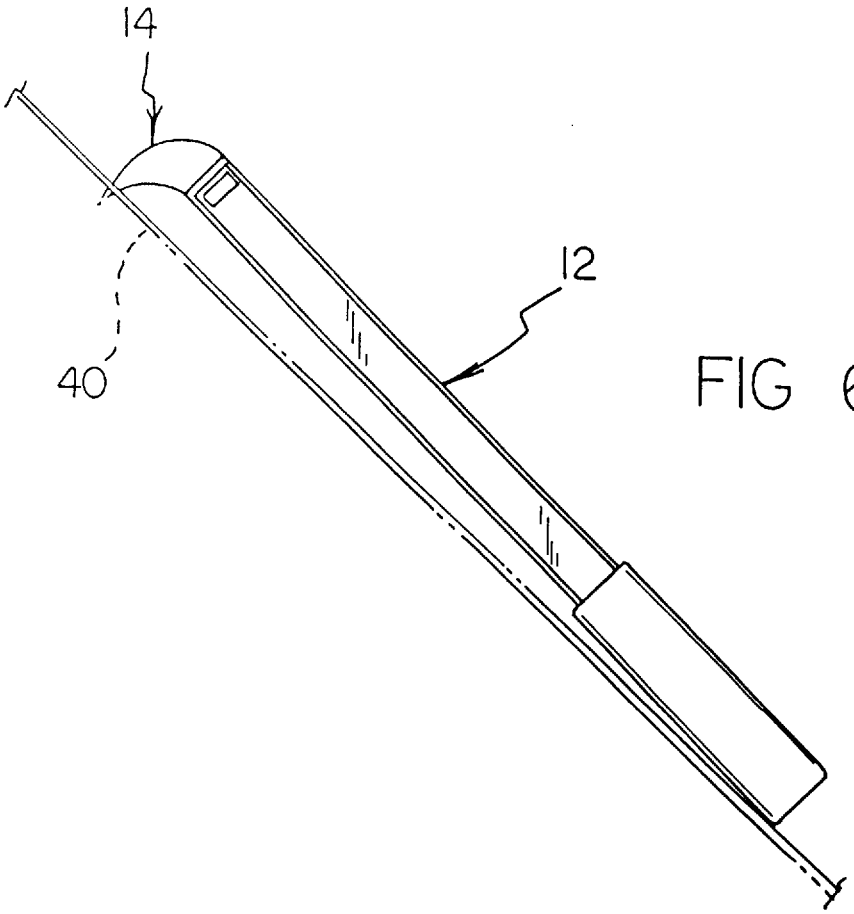
FIG. 6 is a bottom plane view of the device as secured to an underlayment board of a roof structure.

With reference now to the drawings, and in particular to FIGS. 1 6 thereof, a new knife and tacking device embodying the principles and concepts of the present invention and generally designated by the reference numeral 10 will be described. More specifically, it will be noted that the knife and tacking device 10 comprises a tacking means 12 for driving an impact driven fastener Into a surface in response to an impact of the tacking means against such surface. A cutting blade means 14 is secured to the tacking means 12 for cutting objects in response to a manual manipulation of the tacking means.

Figure 2:
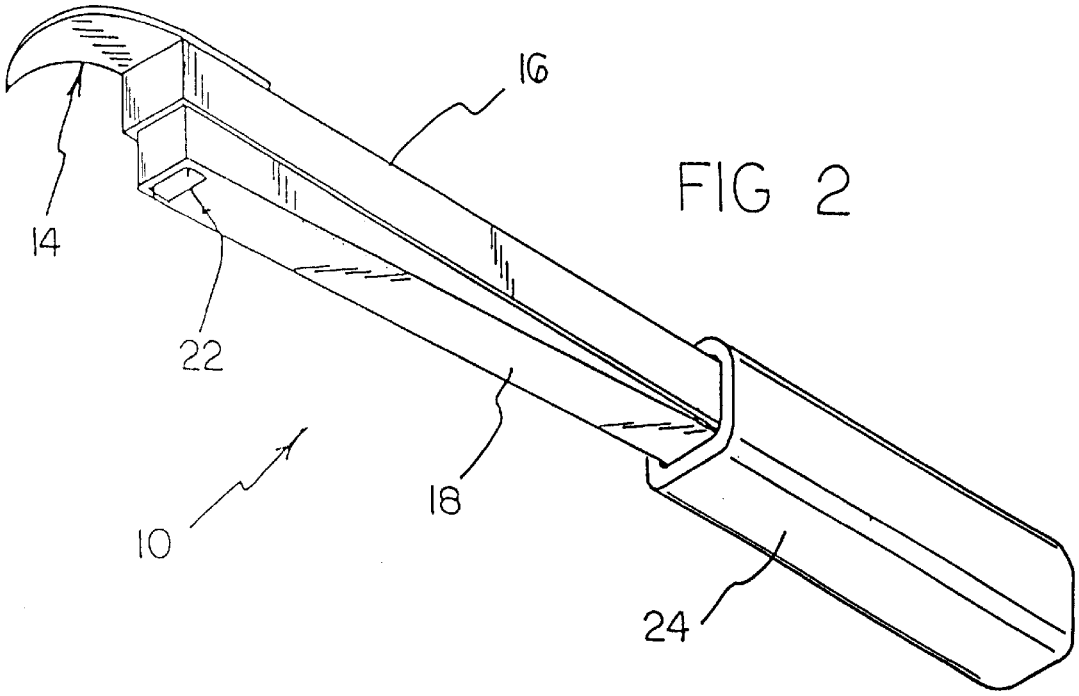
FIG. 2 is a further isometric illustration of the present invention.
Figure 4:
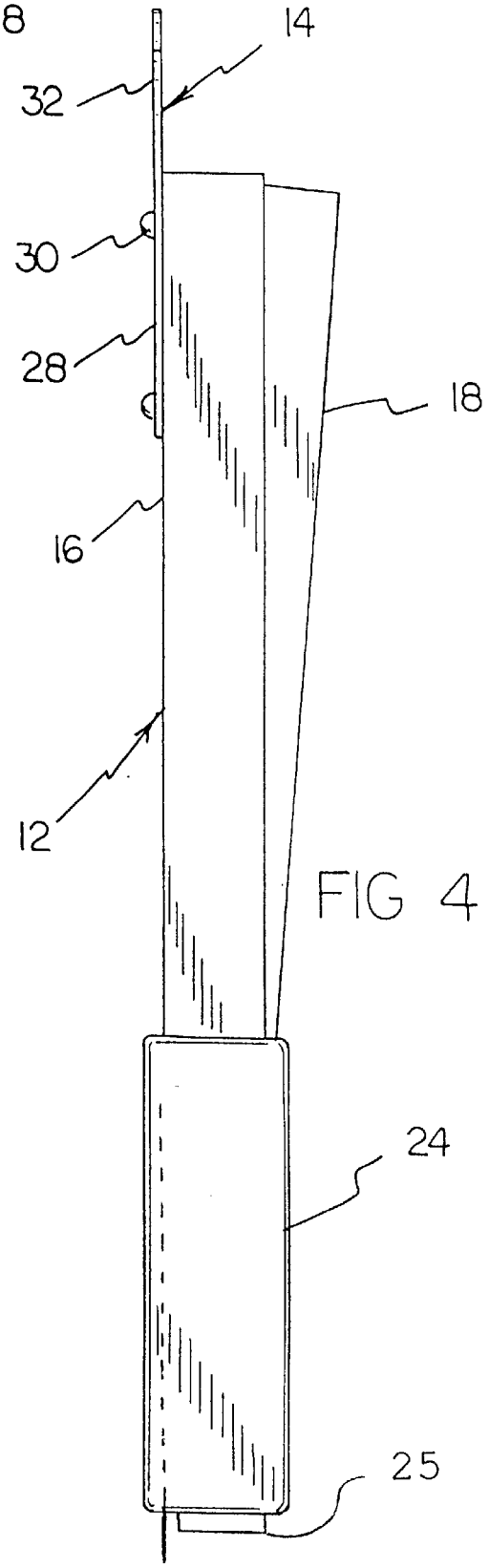
FIG. 4 is a side elevation view of the invention.

As best illustrated in FIGS. 1, 2, and 4, it can be shown that the tacking means 12 according to the present invention 10 preferably comprises an elongated upper channel member 16, with an elongated lower channel member 18 pivotally mounted to the elongated upper channel member at a rearward end 20 thereof. The elongated lower channel member 18 is positioned so as to be pivotally received within the elongated upper channel member 16 and includes a dispensing means 22 mounted within the elongated lower channel member 18 for dispensing an impact driven fastener in response to a pivoting movement of the elongated lower channel member into the elongated upper channel member. By this structure, an impacting of the elongated lower channel member 18 against a surface will drive the lower channel member into the upper channel member 16 and effect dispensing of an impact fastener, such as a tack or a staple, from the dispensing means 22. A handle cover 24 extends about a rearward end 20 of the elongated upper channel member 16 and the lower channel member 18 and provides a gripping surface operable to preclude slipping of the device 10 during manual manipulation thereof. Further, the handle cover affords an unillustrated compartment for storage of staples therein. Such storage and dispensing is done in a conventional manner with a spring and associated tab for forcing the staples to an opening of the dispensing means. Further, a locking tab 25, shown in FIG. 4, is included for permitting access to the compartment of the handle.

Figure 3:
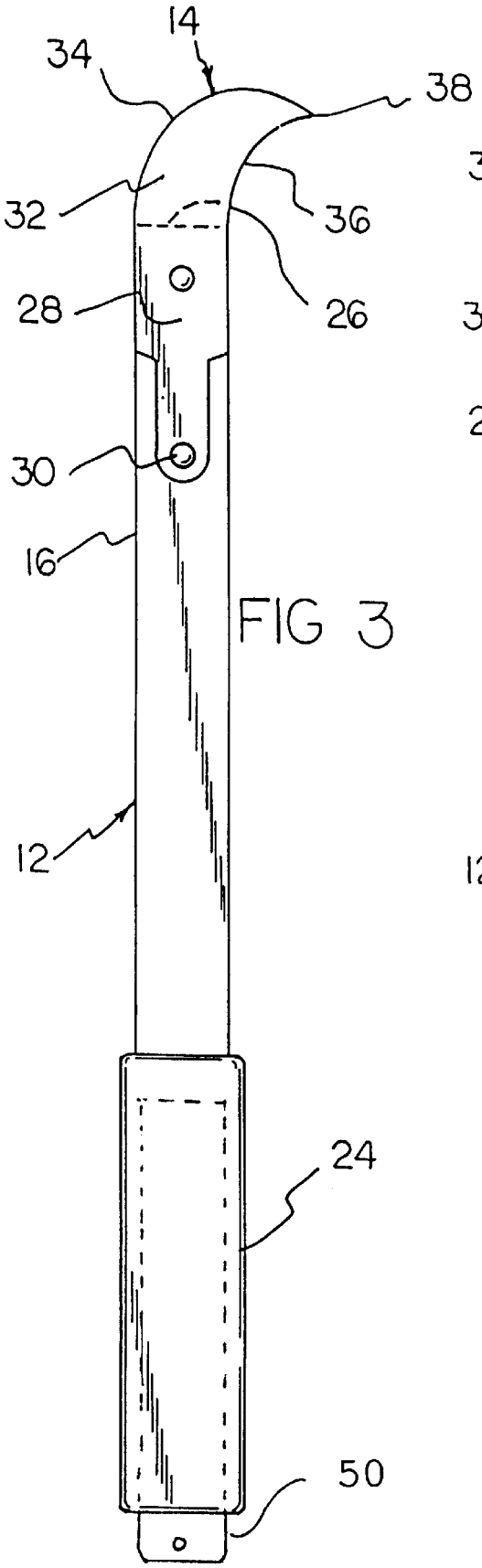
FIG. 3 is a top plan view thereof.

Referring now to FIG. 3 with concurrent reference to Figures previously discussed, it can be shown that the cutting blade means 14 according to the present invention 10 is mounted to the elongated upper channel member 16 so as to project beyond a forward end 26 thereof. To this end, the cutting blade means 14 preferably comprises a planer mounting plate 28 secured to an upper surface of the elongated upper channel member 16 by at least one fastener 30, such as a rivet, threaded fastener, or the like. The planer mounting plate 28 integrally continues into a planar blade plate 32 extending beyond the forward end 26 of the upper channel member 16. The planar blade plate 32 is shaped so as to define an outer arcuate edge 34 continuing through an arc of approximately greater than ninety degrees such that the planar blade plate 32 projects at least partially laterally of the upper channel member 16 substantially as shown in FIG. 3. The planar blade plate 32 is further shaped so as to define an inner arcuate edge 36 extending from an opposed side of the planar mounting plate 28 relative to a side of the planar mounting plate 28 from which the outer arcuate edge 34 continues. The inner arcuate edge 36 similarly extends through an arc of approximately ninety degrees to couple with the outer arcuate edge 34 to define a piercing tip 38 operable to piercingly engage a surface. Either of the edges 34 or 36 can be sharpened to impart a cutting ability to the cutting blade means 14. However, the outer edge 34 is preferably blunt, with only the inner arcuate edge 36 and the piercing tip 38 being sharpened, By this structure, the piercing tip 38 cooperates with the sharpened inner arcuate edge 36 to effect cutting of an object such as sealing paper or the like during a roofing procedure.

Figure 5:
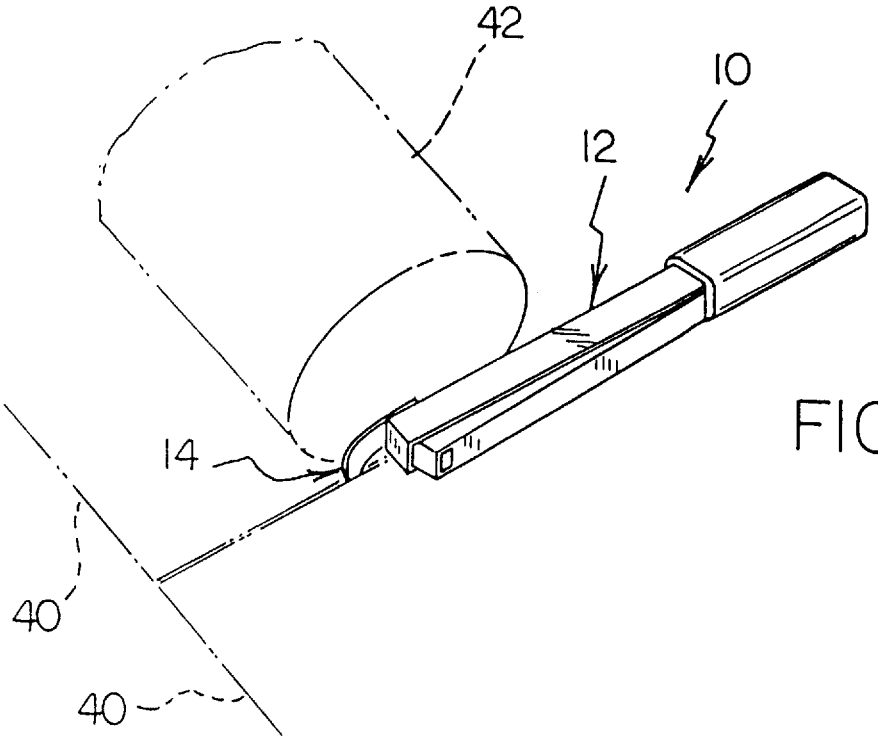
FIG. 5 is a isometric illustration of the present invention utilized as an holding device.

In use, the knife and tacking device 10 according to the present invention can be utilized to both cut objects, as well as to secure objects through the dispensing of an impact driven fastener thereinto. Additionally, and as shown in FIG. 5, the tacking means 12 can be secured between adjacent underlayment boards 40 of an incomplete roof structure by a positioning of the cutting blade means 14 therebetween. A roll of roofing material 42 can then be positioned into abutting engagement with the tacking means 12 to preclude a sliding of the roll of roofing material 42 from the associated incomplete roof structure. Further, the cutting blade means 14 can also be utilized to piercingly engage an underlayment board 40 to suspend or secure the tacking means 12 to the incomplete roof structure. Thus, a synergistic effect between the cutting blade means 14 and the tacking means 12 results from the specific mounting of the cutting blade means 14 relative thereto.

As an option, the handle cover 24 is equipped with a tab 50 extending outwardly therefrom. As shown in FIG. 3, the tab has an aperture formed therein for coupling the present invention to the user or for storage purposes. Preferably, the is integrally coupled to an associated plate situated within an entire length of the handle. This affords a more reliable hanging means. Further, as shown in FIG. 4, the tab extends beyond the locking tab for preventing the inadvertent manipulation and removal of the staples.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A knife and tacking device comprising:

a tacking means for driving an impact driven fastener into a surface in response to an impact of the tacking means against a surface, wherein the tacking means comprises an elongated upper channel member; an elongated lower channel member pivotally mounted to the elongated upper channel member at a rearward end thereof, the elongated lower channel member being positioned so as to be pivotally received within a bottom face the elongated upper channel member; and a dispensing means mounted within the elongated lower channel member for dispensing an impact driven fastener in response to a pivoting movement of the elongated lower channel member into the elongated upper channel member, whereby impacting the elongated lower channel member against a surface drives the lower channel member into the upper channel member thus effecting the dispensing of an impact fastener;

a cutting blade means secured to the tacking means for cutting an object in response to a manual manipulation of the tacking means, wherein the cutting blade means is mounted to the elongated upper channel member so as to project beyond a forward end thereof and comprises a planer mounting plate secured to an upper surface of the elongated upper channel member, the planer mounting plate continuing into a planar blade plate extending beyond a forward end of the upper channel member;

wherein the planar blade plate is shaped so as to define an outer arcuate edge projecting from a first side of the planar mounting plate and continuing through an arc of greater than 90 degrees such that the planar blade plate projects at least partially laterally of the upper channel member, the planar blade plate being further shaped so as to define an inner arcuate edge extending from a second side of the planar mounting plate and continuing through an arc of greater than 90 degrees to couple with the outer arcuate edge to define a piercing tip;

wherein the outer edge is blunt, with the inner arcuate edge and the piercing tip being sharp;

a handle cover extending about a rearward end of the elongated upper channel member and the lower channel member for gripping purposes and further affording a compartment to contain the fasteners which take the form of staples, the handle cover including a locking mechanism for allowing selective access to the staples within the compartment; and a tab coupled to the mounting plate which extends along an entire length of the handle cover, the tab extending from the handle cover with an aperture formed therein, wherein the tab extends beyond the locking mechanism for preventing the inadvertent manipulation thereof.

* * * * *